US006918184B2

(12) United States Patent
Glesser

(10) Patent No.: US 6,918,184 B2
(45) Date of Patent: Jul. 19, 2005

(54) FOLDING KNIFE LOCK WITH INTEGRAL STOP PIN

(75) Inventor: Louis S. Glesser, Evergreen, CO (US)

(73) Assignee: Spyderco, Inc., Golden, CO (US)

( * ) Notice: Subject to any disclaimer, the term of this patent is extended or adjusted under 35 U.S.C. 154(b) by 37 days.

(21) Appl. No.: 10/241,812

(22) Filed: Sep. 10, 2002

(65) Prior Publication Data

US 2004/0045170 A1 Mar. 11, 2004

(51) Int. Cl.[7] ..... B26B 1/04
(52) U.S. Cl. ..... 30/161
(58) Field of Search ..... 30/161, 155

(56) References Cited

U.S. PATENT DOCUMENTS 3,783,509 A * 1/1974 Lake ..... 30/161
4,703,560 A * 11/1987 Brooker ..... 30/155
4,811,486 A * 3/1989 Cunningham ..... 30/161
4,974,323 A 12/1990 Cassady ..... 30/155
4,985,998 A 1/1991 Howard ..... 30/158
5,325,588 A * 7/1994 Rogers ..... 30/161
5,685,079 A 11/1997 Brothers et al. ..... 30/161
5,722,168 A * 3/1998 Huang ..... 30/161
6,088,861 A * 7/2000 Sessions et al. ..... 7/128
6,490,797 B1 * 12/2002 Lake et al. ..... 30/161
6,523,265 B2 * 2/2003 Eickhorn ..... 30/161
6,591,505 B2 * 7/2003 Flavigny ..... 30/161

* cited by examiner

*Primary Examiner*—Charles Goodman
(74) *Attorney, Agent, or Firm*—Sheridan Ross P.C.

(57) ABSTRACT

The present invention relates to folding knives and implements, and more specifically to a locking mechanism used to prevent the inadvertent closing of the knife blade as well as overextension of the knife blade during use.

20 Claims, 6 Drawing Sheets

FOLDING KNIFE LOCK WITH INTEGRAL STOP PIN

FIELD OF THE INVENTION

The present invention relates to hand held folding knives, and more specifically folding knives which have a locking mechanism for engaging the blade to prevent the blade from inadvertently closing.

BACKGROUND OF THE INVENTION

Pocket knives are commonly used by sportsmen, craftsmen and others who desire a compact, portable blade which can be safely folded and transported in a pocket or attached to a belt. Unfortunately, many of the folding blades commonly associated with these types of pocket knives do not have locking mechanisms to prevent the blades from inadvertently closing. Thus, the folding knife can be potentially dangerous to use if the sharpened blade inadvertently closes.

More recently, locking devices have been incorporated into folding knives to prevent the inadvertent closing of the knife blade. One type of locking mechanism known in the art is a "liner lock" which utilizes a leaf spring positioned within the cavity of the knife handle and which engages the heel end of the knife blade. The blade is typically released by the user by applying finger pressure to the leaf spring, thus releasing the leaf spring from the knife blade.

Another commonly used folding knife locking mechanism is a "back lock", which utilizes a locking bar positioned along an upper edge of the knife handle. When finger pressure is applied to a rear portion of the locking bar, a tang interconnected to a forward portion of the locking bar is withdrawn from a cut-out "anvil" located in the heel end of the blade. When the tang is released from the anvil, the knife blade is allowed to rotate between a first extended position of use and a second closed position wherein at least a portion of the knife blade is stored within a cavity in the knife handle.

Unfortunately, with both liner locks and back lock locking mechanisms, it is possible for the locking apparatus to potentially become disengaged from the blade after excessive and continuous use. Further, the positioning of the liner lock and back lock are often difficult to locate with a user's fingers, and cannot be accessed on both a front and rear side of the knife handle. Additionally, these type of locking mechanisms require the use of a "stop pin", which is positioned on a forward portion of the handle above the pivot pin of the blade, and proximate to an upper edge of the handle. The stop pin prevents the knife blade from overrotating when the blade is in an extended position of use by directly contacting a heel portion of the blade.

Thus, there is a need for an improved folding knife locking mechanism which is mechanically simplistic, uses a minimum number of components and is extremely reliable to prevent the inadvertent closure of the knife blade. There is an additional need for a locking mechanism which is positioned to allow quick and easy access by one or more of a user's fingers on both sides of the knife handle, and which eliminates the need for a stop pin.

SUMMARY OF THE INVENTION

It is thus one aspect of the present invention to provide a blade locking mechanism which serves the dual purpose of locking a folding knife blade in an extended position of use, and simultaneously serves as a stop pin, thus eliminating the necessity of a secondary component. Thus, in one embodiment of the present invention a locking mechanism is provided which has an anvil with a lower surface and an upper surface which mainly engages the heel portion of the knife blade to prevent inadvertent closure, and overextension of the knife blade.

It is another aspect of the present invention to provide a locking mechanism for a folding knife or multi-tool which is positioned immediately opposite a user's thumb or fingers and which is thus immediately accessible for selective opening. Thus, in one embodiment of the present invention the lock release mechanism is positioned immediately adjacent to a user's thumb or finger, and may be accessed on both sides of a folding knife handle. Alternatively, the lock release mechanism is positioned along an upper edge of the knife handle, and is then held downward with hand pressure during use, thus making it substantially "fail safe" and incapable of opening while being used.

It is a further aspect of the present invention to provide a locking mechanism which has a biasing means which continually biases the locking mechanism to secure the blade while it is in an extended position, and thus cannot be inadvertently closed. Thus, to release the blade the locking mechanism must be engaged by a user's thumb or finger and pushed in a predetermined direction by the user, thus making it substantially impossible for the knife locking mechanism to fail. Alternatively, the locking mechanism may be oriented in numerous different directions to accommodate certain handle and blade designs, and may be used without any type of biasing means. In these embodiments, the locking mechanism can be engaged or disengaged with the tang of the folding knife blade by means of gravity or by pressure from a user's fingers.

It is yet another aspect of the present invention to provide a blade locking mechanism which is simplistic to use, cost effective to manufacture and requires a minimum number of components which are not susceptible to failure after repeated use. Thus, in one embodiment of the present invention a locking mechanism is provided which both locks the knife blade in an extended position of use, and also prevents overtravel, thus eliminating the stop pin.

Thus, in one aspect of the present invention, a folding knife with an integral blade locking mechanism and stop pin are provided, comprising:

a central body;

an aperture extending through said central body;

a pivot pin extending through said aperture and operably interconnected to a handle of the folding knife, wherein said central body rotates with respect to the handle;

an anvil extending outwardly from said central body and adapted to engage a tang positioned on a heel end of a blade on the folding knife when the blade is in a first extended position of use;

an overtravel surface positioned on a forward edge of said central body which is adapted to operably engage the heel end of the folding knife blade when the blade is in said first extended position of use;

wherein when said central body is rotated, said anvil is disengaged from the tang of the blade and the knife blade is unrestricted to travel between said first extended position of use to a second closed position with a lower edge of the blade substantially enclosed within a cavity of the folding knife handle.

DETAILED DESCRIPTION

Figure 1:
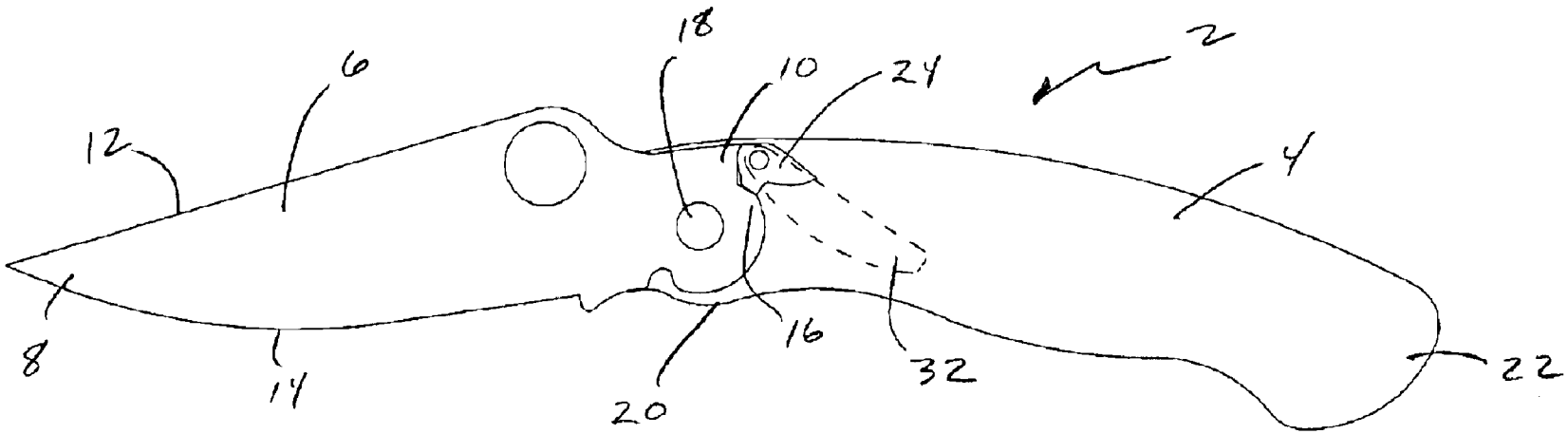
FIG. 1 is a front elevation view of one embodiment of the present invention showing a folding knife extended in a position of use with the front scale of the handle removed for clarity.

Referring now to the drawings, FIG. 1 is a front elevation view of one embodiment of the present invention and which depicts a folding knife 2 with a blade 6 in a first extended position of use. The front scale of the handle 4 is removed for clarity and to identify the various components of the locking mechanism 24. More specifically, the folding knife 2 generally comprises a blade 6 which is rotatably interconnected to a handle 4. The blade includes a front end 8, blade heel end 10, a blade upper edge 12, and a blade lower edge 14 which is typically sharpened, as well as a blade tang 16 positioned proximate to the heel end 10, and which engages the locking mechanism 24 of the present invention.

In the embodiment shown in FIG. 1, the locking mechanism 24 generally comprises a locking anvil 26 which engages the blade tang 16, and which further includes a blade overtravel surface 28 which is used to prevent the blade heel end 10 from overextending when the blade 6 is in an extended position of use as shown. This combined feature of the locking mechanism 24 eliminates the need for a stop pin. Additionally, and as shown in dotted lines, the blade locking mechanism 24 may be interconnected to a locking lever 32 which is engaged by a user's finger to alternatively lock and unlock the blade to allow the blade to rotate between a first extended position of use and a second closed position. As appreciated by one skilled in the art, the blade locking lever 32 may be comprised of any numerous variations of levers or slides which serve the purpose of rotating the locking anvil 26 around the locking mechanism pivot pin 30.

Figure 2:
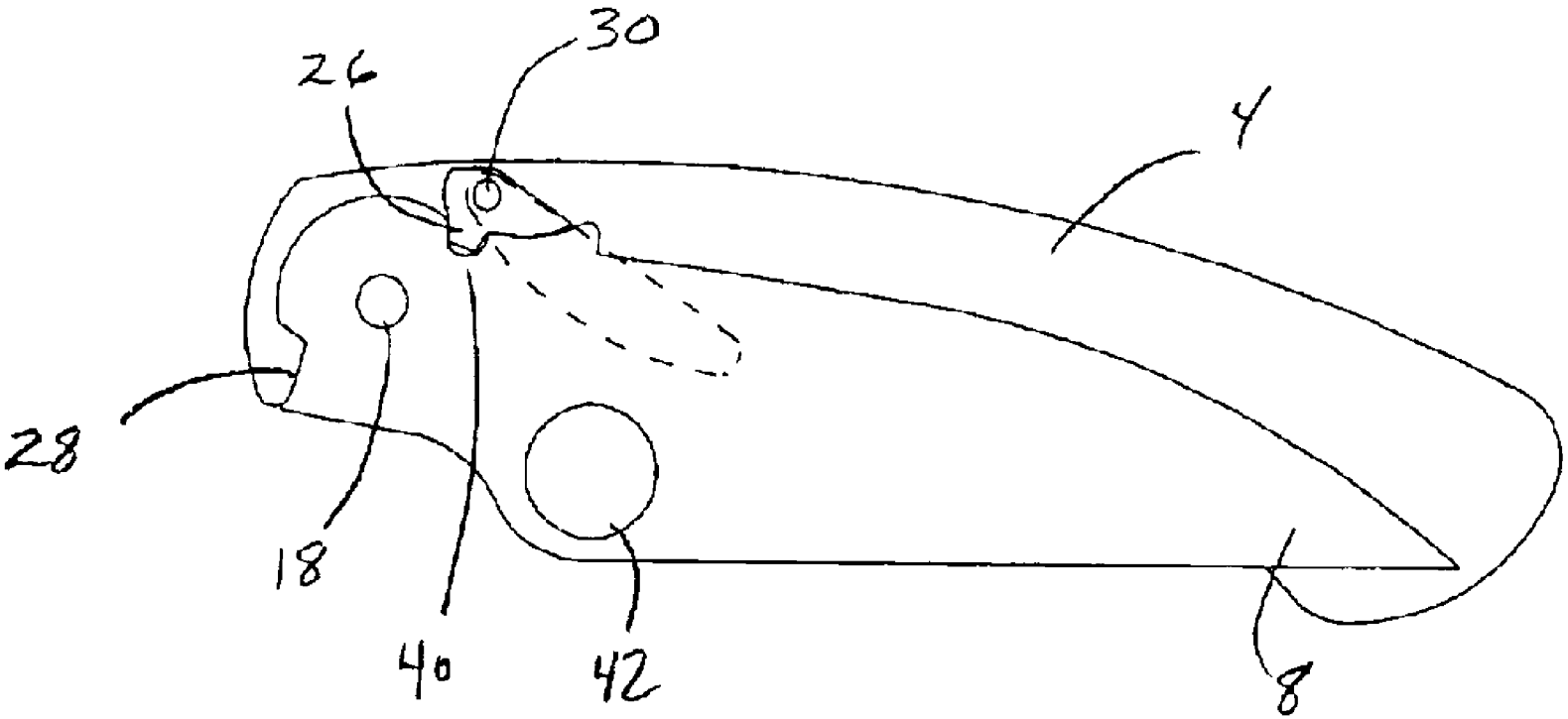
FIG. 2 shows the folding knife of FIG. 1 in a closed position.

Referring now to FIG. 2, the folding knife 2 shown in FIG. 1 is further depicted with the blade in a second closed position. In this particular position, the blade lower edge 14 is located within a cavity in the blade handle 4, and thus prevents a user from inadvertently being cut or injured. Further, the locking anvil 26 is shown engaged in a blade catch slot 40 which is used to substantially maintain the blade 6 in a closed position until finger pressure is applied to a blade aperture 42 or other opening device such as a thumb stud to allow the blade 6 to be rotated from the closed position to a first extended position of use as shown in FIG. 1.

Figure 3:
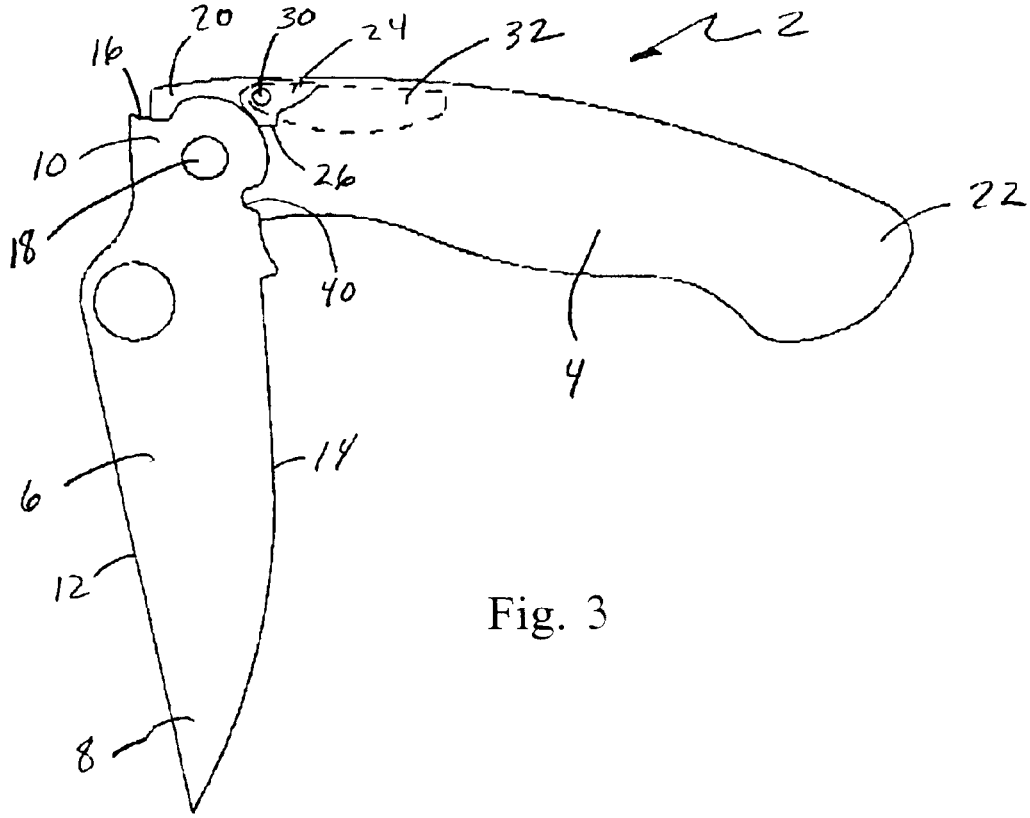
FIG. 3 shows the folding knife of FIG. 1 in an intermediate position between a first extended position of use and a second closed position.

Referring now to FIG. 3, the folding knife 2 is depicted in an intermediate position between the first extended position of use and the second closed position. As the blade 6 rotates between the first extended position and second closed position, the locking anvil 26 is maintained in a position which allows rotation, yet when the blade becomes closed the locking anvil 26 engages the blade catch slot 40. When the blade is fully extended, the locking anvil 26 engages the blade tang 16, and is thus locked into position to prevent rotation. When pressure is applied to the blade, an upper edge 12 of the blade 6 is secured by the locking anvil 26 and thus prevented from inadvertently rotating.

Figure 4:
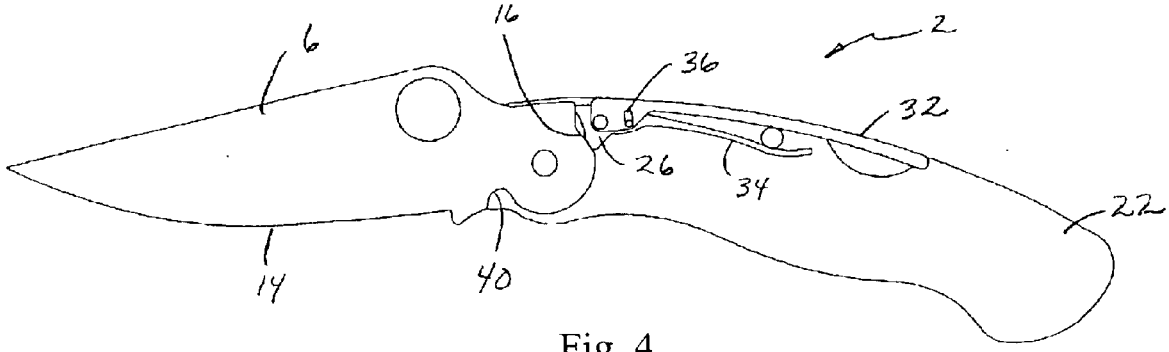
FIG. 4 is a front elevation view of an alternative embodiment of the present invention and identifying a folding knife in an extended position of use with a biasing spring and locking lever, the front scale of the handle removed for clarity.
Figure 5:
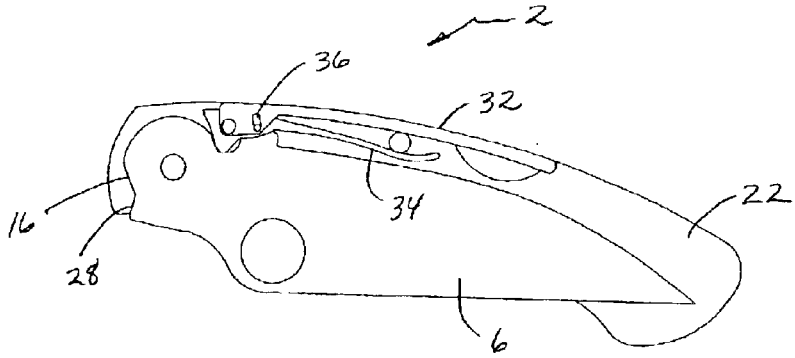
FIG. 5 is a front elevation view of the embodiment shown in FIG. 4 with the blade in a closed position.
Figure 6:
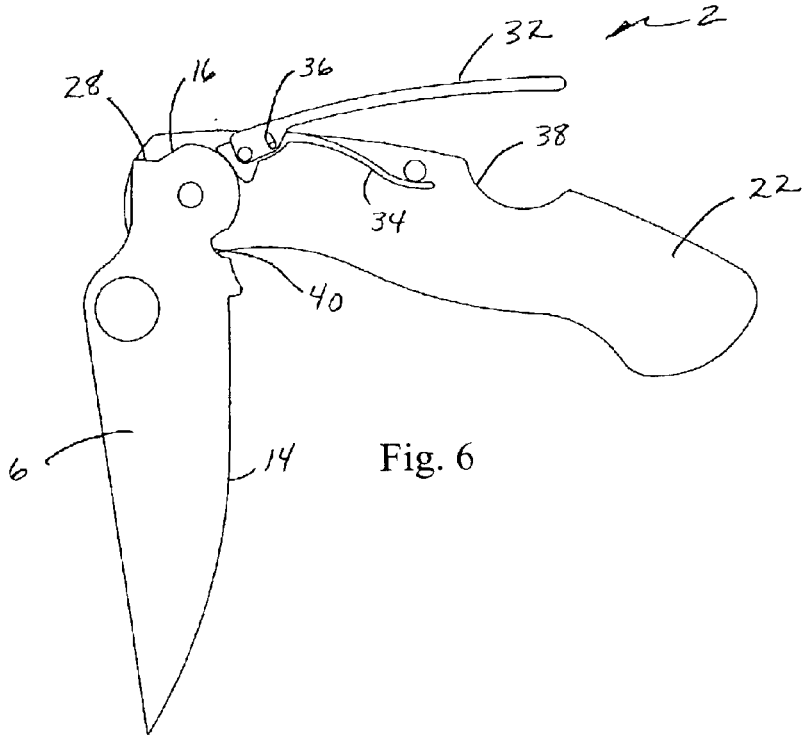
FIG. 6 is a front elevation view the embodiment shown in FIG. 4 with the blade in an intermediate position.

Referring now to FIGS. 4–6, a front elevation view is provided of an alternative embodiment of the present invention, and further depicting a folding knife 2 shown in a first extended position of use (FIG. 4), an intermediate position of use (FIG. 6), and a closed position (FIG. 5). In this particular embodiment, a locking lever 32 is shown which has considerably more length than the embodiment shown in FIG. 1, and which is positioned along an upper edge of the handle 4 and which extends over a handle finger depression 38. The handle finger depression 38 allows easy access to the locking lever 32, and which is pulled upward to allow rotation of the blade 6 around the blade pivot pin 18. As further shown in these drawings, the overtravel surface 28 of the blade is clearly identified and which engages a portion of the locking anvil 26 of the locking mechanism 24. This overtravel surface 28 and the associated locking mechanism 24 prevents the blade from over-extending when force is applied to a blade lower edge 14, and thus eliminates the need of a stop pin which is typically positioned between the blade tang 16 and locking mechanisms in a typical folding knife 2. As further identified in FIGS. 4–6, a biasing spring 34 is provided which maintains the locking lever 32 in a downward position until an upward force is applied to release the locking anvil 26 from the blade tang 16. As further shown in FIG. 5, when the blade 6 is in a closed position the locking anvil 26 is positioned within the blade catch slot 40 and which retains the blade in a closed position until a downward force is applied to the blade 6 to promote rotation.

Figure 7:
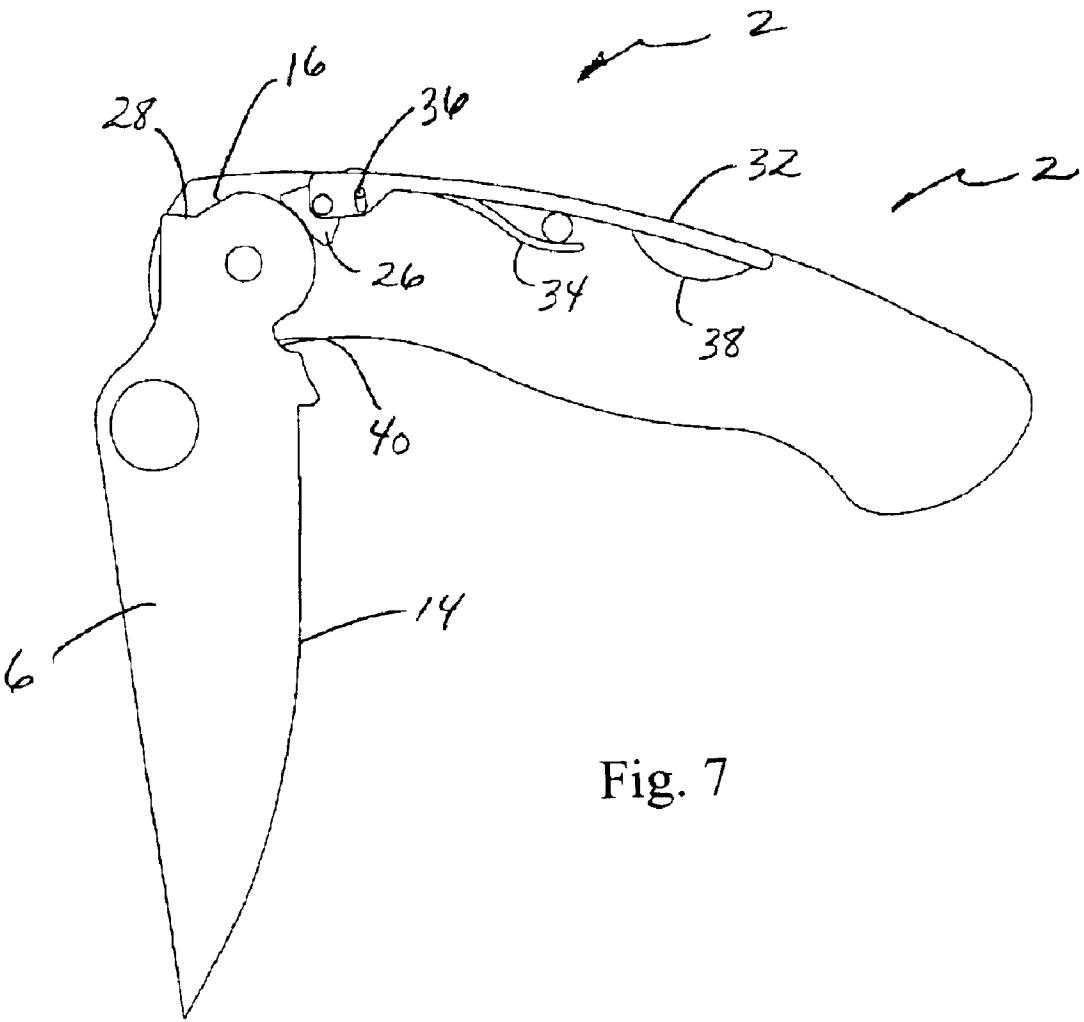
FIG. 7 is a front elevation view of the knife embodiment shown in FIG. 4 and further identifying a racheting mechanism associated with the folding lever and locking mechanism.

Referring now to FIG. 7, the blade 6 is shown in an intermediate position of travel between a first extended position and a second closed position. More specifically, the ratcheting slot and pin 36 and their relative position during rotation of the blade are shown herein. Comparing FIGS. 6 and 7, when the locking lever 32 is pulled upwardly as shown in FIG. 6, the ratcheting pin is positioned in a lower portion of the slot, while in FIG. 7 when the locking lever 32 is positioned proximate to the knife handle, the ratcheting pin 36 is positioned in an upper portion of the ratcheting slot.

Figure 8:
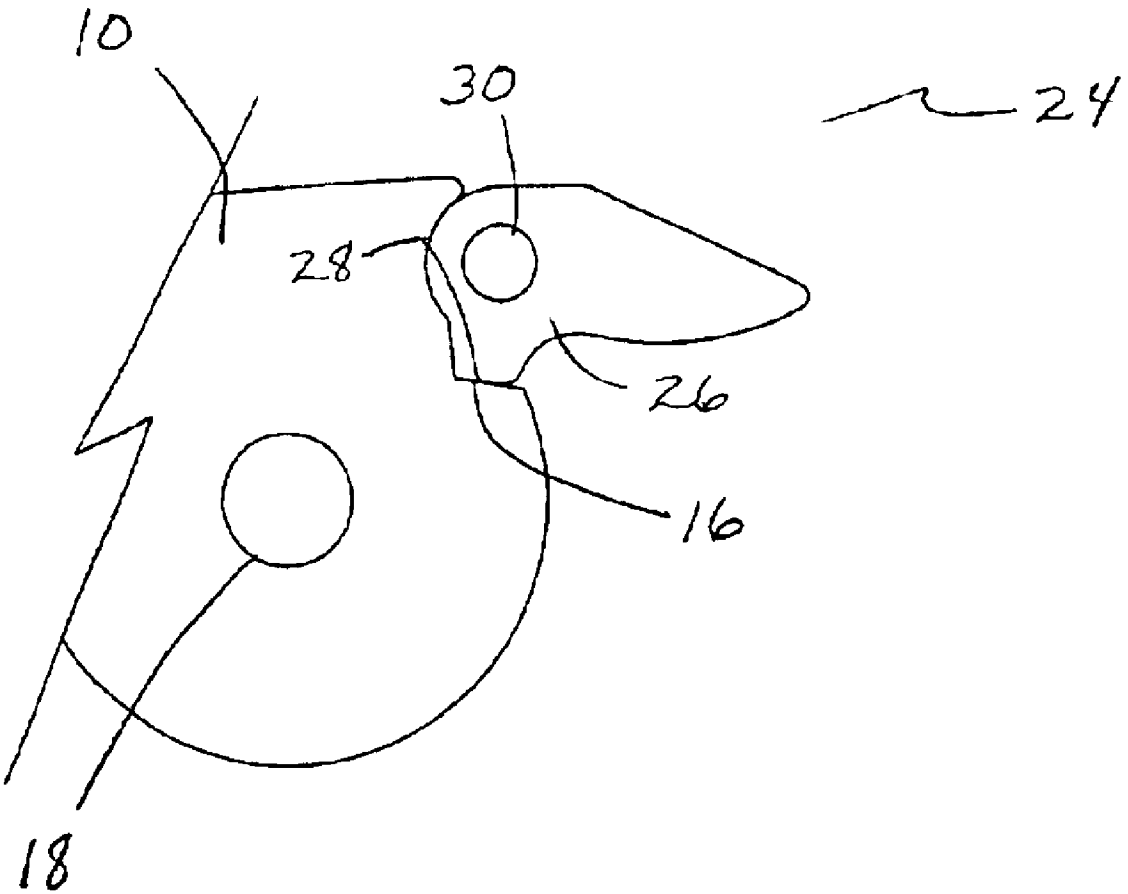
FIG. 8 is an expanded front elevation view of the locking mechanism and blade tang in one embodiment of the present invention.

Referring now to FIG. 8, an expanded view of the locking mechanism 24 of the present invention is provided in greater detail and with respect to a blade heel end 10. This enlarged drawing shows the components of the locking mechanism 24, with respect to the blade, and including the locking anvil 26 and the locking mechanism pivot pin 30. The blade heel end 10 further comprises a blade tang 16 which engages the locking anvil 26 when the blade is in a first extended position of use. Furthermore, the blade overtravel surface 28 is shown contacting an upper portion of the anvil 26 to prevent the blade 6 from overextending when the blade is in a first extended position of use. Thus, the dual role of the locking mechanism 24 can clearly be shown in FIG. 8, wherein the blade is prevented from overextending due to the contact between the overtravel surface 28 and the upper portion of the locking anvil 26, and is further prevented from closing due to the contact between a lower portion of the locking anvil 26 and the blade tang 16.

For clarity purposes, a list of components and associated numbering shown in the attached drawings are provided herein:

| # | Component |
|---|---|
| 2 | Folding knife |
| 4 | Handle |
| 6 | Blade |
| 8 | Blade front end |
| 10 | Blade heel end |
| 12 | Blade upper edge |
| 14 | Blade lower edge |
| 16 | Blade tang |
| 18 | Blade pivot pin |
| 20 | Handle front end |
| 22 | Handle rear end |
| 24 | Locking mechanism |
| 26 | Locking anvil |
| 28 | Overtravel surface |
| 30 | Locking mechanism pivot pin |
| 32 | Locking lever |
| 34 | Biasing spring |
| 36 | Ratcheting slot and pin |
| 38 | Handle finger depression |
| 40 | Blade catch slot |

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A folding knife with an integral blade locking mechanism and blade stop pin, comprising:

a handle having a front end, a rear end and a cavity positioned substantially therebetween;

a blade having a front end, a heel end, an upper edge and a lower edge, said heel end rotatably interconnected to said front end of said handle;

a tang positioned on a heel end of said blade;

a locking mechanism pivot pin operably interconnected to said handle;

a locking mechanism, comprising:

a central body with an aperture extending therethrough which is rotatably interconnected to said locking mechanism pivot pin, wherein said central body rotates around an axis defined by said locking mechanism pivot pin and positioned proximate to said heel end of said blade;

an anvil extending outwardly from said central body for operable engagement with said tang when said blade is in a first extended position of use which is substantially an extension of said handle;

an overtravel surface located on a forward portion of said central body for engaging said heal end of said blade when said blade is in said first extended position of use; and a rotation means interconnected to said central body, wherein said locking mechanism may be rotated to allow said blade to travel between said first extended position and said second closed position.

2. The folding knife of claim 1, wherein said rotation means comprises a lever having a first end and a second end, said second end positioned for operable engagement with a user's fingers.

3. The folding knife of claim 2, wherein said second end of said lever is positioned proximate to an upper edge of said handle.

4. The folding knife of claim 2, wherein said handle has a thumb notch positioned proximate to said upper edge which exposes at least a portion of said second end of said lever.

5. The folding knife of claim 1, wherein said blade heel end comprises a second tang for operable engagement with said anvil when said blade is in said closed position.

6. The folding knife of claim 1, further comprising a biasing means in operable engagement with said locking mechanism, wherein a force must be applied to rotate said central body.

7. The folding knife of claim 6, wherein said biasing means comprises a leaf spring.

8. A folding knife, comprising:

a handle having a front end, a rear end and a cavity positioned substantially therebetween;

a blade having a front end, a heel end, an upper edge and a lower edge, said heel end rotatably interconnected to said front end of said handle;

a tang positioned on a heel end of said blade;

a locking mechanism pivot pin operably interconnected to said handle;

a locking mechanism, comprising:

a central body with an aperture extending therethrough which is rotatably interconnected to said locking mechanism pivot pin, wherein said central body rotates around an axis defined by said locking mechanism pivot pin, said axis positioned proximate to said heel end of said blade;

an anvil extending outwardly from said central body for operable engagement with said tang when said blade is in a first extended position of use which is substantially an extension of said handle;

an overtravel surface located on a forward portion of said central body for engaging said heal end of said blade when said blade is in said first extended position of use; and a rotation means interconnected to said central body, wherein said locking mechanism may be rotated to allow said blade to travel between said first extended position and a second closed position with said blade lower edge positioned substantially within said cavity.

9. The folding knife of claim 8, further comprising a biasing spring positioned in operable engagement with said rotation means, wherein a force must be applied to said rotation means to release said anvil from said tang.

10. The folding knife of claim 8, wherein said rotation means comprises a lever having a first end and a second end, said first end operably interconnected to said control body.

11. The folding knife of claim 8, further comprises a second tang positioned on said heel end of said blade for operable engagement with said anvil when said blade is in said second closed position.

12. A locking mechanism with an integral stop pin which is adapted for use with a folding knife, comprising:

a central body;

an aperture extending through said central body;

a pivot pin extending through said aperture and operably interconnected to a forward end of a handle of the folding knife and positioned proximate to a heel end of a blade, wherein said central body rotates around said pivot pin;

an anvil extending outwardly from said central body and adapted to engage a tang positioned on the heel end of the blade on the folding knife when the blade is in a first extended position of use;

an overtravel surface positioned on a forward edge of said central body which is adapted to operably engage the heel end of the folding knife blade when the blade is in said first extended position of use;

wherein when said central body is rotated, said anvil is disengaged from the tang of the blade and the knife blade is unrestricted to travel between said first extended position of use to a second closed position with a lower edge of the blade substantially enclosed within a cavity of the folding knife handle.

13. The locking mechanism of claim 12, further comprising a lever having a first end and a second end, said first end operably interconnected to said central body, wherein moving said second end of said lever rotates said central body.

14. The locking mechanism of claim 12, wherein said lever second end is raised upwardly to release said anvil from said tang and allow said blade to rotate to said second closed position.

15. The locking mechanism of claim 12, wherein said central body is comprised of a metallic material.

16. The locking mechanism of claim 12, wherein said overtravel surface has a non-linear arcuate shape.

17. The locking mechanism of claim 12, wherein said overtravel surfaces is at least about 0.125 inches long.

18. The locking mechanism of claim 13, further comprising a biasing means which is in operable engagement with said lever, wherein a force must be applied to said second end of said lever to release said anvil from said tang.

19. The locking mechanism of claim 18, wherein said biasing means comprises a leaf spring.

20. The locking mechanism of claim 12, further comprising a second tang positioned in said heel of said blade which engages said anvil when said knife blade is in said second closed position.

* * * * *